United States Patent [19]

Nestor

[11] Patent Number: 4,474,420

[45] Date of Patent: Oct. 2, 1984

[54] ELECTRICAL CONNECTOR FOR FLEXIBLE PRINTED CIRCUITS

[75] Inventor: Charles R. Nestor, Niles, Ohio

[73] Assignee: General Motors Corporation, Detroit, Mich.

[21] Appl. No.: 572,977

[22] Filed: Jan. 24, 1984

Related U.S. Application Data

[63] Continuation of Ser. No. 293,692, Aug. 17, 1981, abandoned.

[51] Int. Cl.[3] ..... H01R 13/50; H01R 11/22

[52] U.S. Cl. ..... 339/116 MF; 339/252 R

[58] Field of Search ..... 339/17 F, 176 MF, 252 R, 339/252 P

[56] References Cited

U.S. PATENT DOCUMENTS

| | | | |
|---|---|---|---|
| 2,809,361 | 10/1957 | Woofter et al. | 339/176 |
| 2,956,260 | 10/1960 | Bennett | 339/176 |
| 3,277,425 | 10/1966 | Marshall et al. | 339/17 F |
| 3,365,694 | 1/1968 | Parker | 339/17 F |
| 3,417,362 | 12/1968 | Reynolds | 339/176 |
| 3,601,785 | 8/1971 | Longenecker et al. | 339/256 |
| 3,646,504 | 2/1972 | Classon | 339/176 MP |
| 4,035,050 | 7/1977 | Volinskie | 339/176 MF |
| 4,040,704 | 8/1977 | Huber | 339/176 MF |
| 4,066,325 | 1/1978 | Pearce, Jr. et al. | 339/176 MP |
| 4,083,615 | 4/1978 | Volinskie | 339/176 MF |

FOREIGN PATENT DOCUMENTS

| | | | |
|---|---|---|---|
| 2014830 | 11/1970 | Fed. Rep. of Germany . | |
| 1496312 | 8/1978 | France | 339/17 F |

*Primary Examiner*—John McQuade
*Assistant Examiner*—Gary F. Paumen
*Attorney, Agent, or Firm*—F. J. Fodale

[57] ABSTRACT

An electrical connector for a flexible printed circuit comprises a connector body having two rows of open channels and a terminal disposed in each channel. Each channel has a longitudinal rib which projects from a partition wall on one side of the channel and is spaced from the partition wall on the other side of the channel and which cooperates with a base wall of the connector body to define a slot. The terminals have a side wall disposed between the longitudinal rib and the partition wall on the other side of the channel and a lateral flange which is attached to a longitudinal edge of the side wall and which is disposed in the slot to retain the terminal in the transverse direction. The terminals further comprise a contact bow which is attached to a forward edge of the lateral flange and has a nose portion seated against the longitudinal rib to retain the terminal in one longitudinal direction. The median portion of the contact bow projects outwardly of the channel for making an electrical connection with a flexible printed circuit.

9 Claims, 7 Drawing Figures

ELECTRICAL CONNECTOR FOR FLEXIBLE PRINTED CIRCUITS

This is a continuation of application Ser. No. 293,692, filed on Aug. 17, 1981, now abandoned.

This invention relates generally to terminals and electrical connectors for flexible printed circuits and the like and, more particularly, to a terminal and an electrical connector of the wipe-in type, such as is disclosed in U.S. Pat. No. 3,365,694 granted to George W. Parker on Jan. 23, 1968.

The connector disclosed in the Parker patent comprises a plug body 26 having two rows of parallel pockets 25 and a plurality of terminals 21 attached to the ends of insulated conductor wires 22A. The terminals 21 are disposed in the pockets 25 and have bowed contact portions 20 which project laterally outwardly of the plug body 26. The bowed contact portions 20 have a wipe-in engagement with conductive portions of a flexible printed circuit when the plug body 26 is plugged into a panel 10 or 30 supporting the flexible printed circuit.

The object of this invention is to generally improve upon the terminal and electrical connector disclosed in the Parker patent.

One feature of the invention is that the terminals are seated against solid portions of the plug body to prevent pushout when the terminals engage the flexible printed circuit.

Another feature of the invention is that the terminals are very narrow which reduces the overall width of the electrical connector and permits a closer spacing of the printed circuit conductors.

Other objects and features of the invention will become apparent to those skilled in the art as the disclosure is made in the following detailed description of a preferred embodiment of the invention as illustrated in the accompanying sheets of drawing in which.

Figure 1:
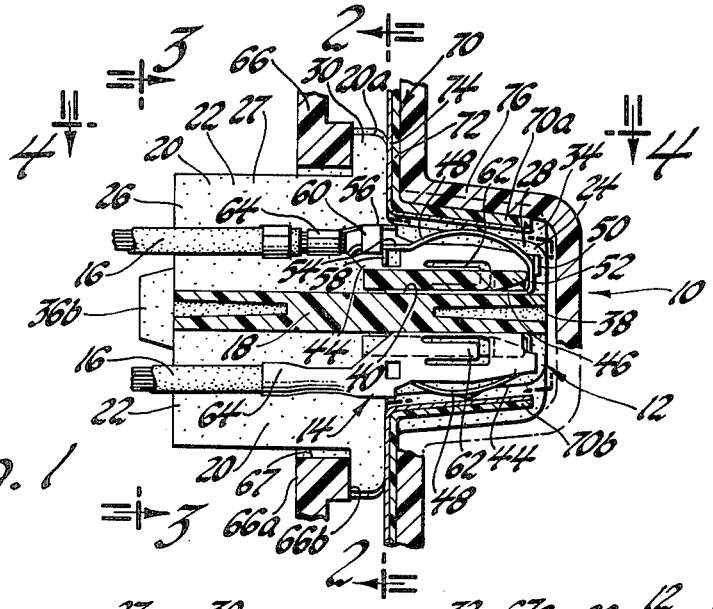
FIG. 1 is a longitudinal section of a terminal and an electrical connector in accordance with this invention mated with a flexible printed circuit.

Referring now to the drawing and particularly to FIG. 1, the electrical connector 10 comprises a plug connector body 12 of dielectric material and a plurality of terminals 14 which are attached to the stripped ends of insulated cables 16.

The connector body 12 comprises a horizontal or base wall 18 and a plurality of upstanding partition walls 20 which extend from both sides of the base wall 18 to define two rows of open channels 22. The channels 22 have front openings 24 and rear openings 26 at the opposite longitudinal ends of the connector body 10 and longitudinal openings 27 opposite the base wall 18.

The longitudinal openings 27 extend the entire length of the connector body 12 and communicate with the respective front and rear openings 24 and 26.

The partition walls 20 have tapered plug-in portions 28 at the front end of the connector body 12 and intermediate wings 30 which serve as stops.

Two inner partition walls 20*a* are joined together to provide a pair of sockets 32. The sockets 32 are closer to one side of the connector body 12 and serve as indexing means to assure proper panel mounting and connection with the flexible printed circuit as will hereinafter more fully appear.

The four outer partition walls 20*b* have a gusset 34 attached to their respective plug-in portions 28 and one of the wings 30. The outer partition walls 20*b* also have latch arms 36*a* and 36*b* attached to their rearward portions. The latch arms 36*a* and 36*b* are different sizes and also serve as indexing means to assure proper panel mounting.

Figure 4:
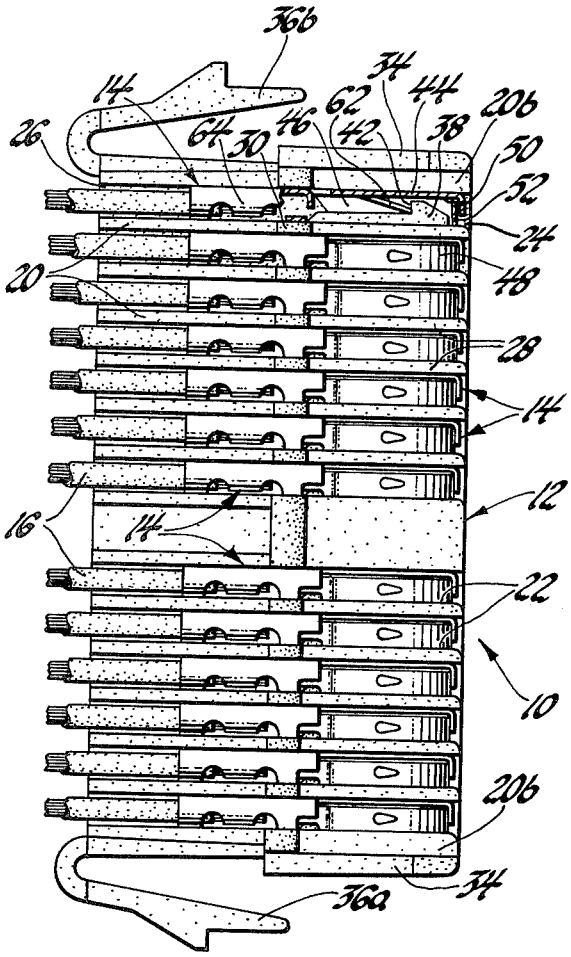
FIG. 4 is a section taken substantially along the line 4—4 of FIG. 1 looking in the direction of the arrows.

Each channel 22 has a longitudinal rib 38 projecting into it from a partition wall 20, 20*a* or 20*b* at one side of the channel. Each rib 38 is parallel to, and shaped a short distance from, the base wall 18 to define a narrow slot 40 in each channel 22 as shown in FIG. 1. Each longitudinal rib 38 is also spaced from the partition wall 20, 20*a* or 20*b* on the opposite side of the channel 22 and has a shoulder 42 which faces the rear opening 26 of the channel as shown in FIG. 4.

Each terminal 14 is a unitary sheet metal stamping which is bent to shape and a flat side wall 44 which has a lateral flange 46 integrally attached at a longitudinal edge of its flat side wall. Each terminal 14 further includes a contact bow 48 which is attached to the front edge of the lateral flange 46 and bent back over the lateral flange 46 so that the bow 48 has a median portion which projects outwardly of its side wall 44. The side wall 44 has a bent front tab 50 which extends in front of the contact bow 48 to protect and reinforce the nose 52 of the contact bow.

The contact bow 48 also has a tail 54 which lies between a small lateral flange 56 integrally attached to a longitudinal edge of the side wall 44 (opposite the lateral flange 46) and a side tab 58 struck and bent from the side wall 44. The tail 54 is trapped laterally between the side wall 44 and a depending finger 60 which extends from the small lateral flange 56 past the side tab 58. The side wall 44 also has a longitudinal latch tang 62 struck and bent therefrom.

The terminal 14 is attached to the cable 16 by a standard double crimp barrel attachment 64 which is integrally connected to a rear edge of the side wall 44 and offset toward the small lateral flange 56 so that it does not interfere with assembly on the terminal 14 into the channel 22.

Figure 2:
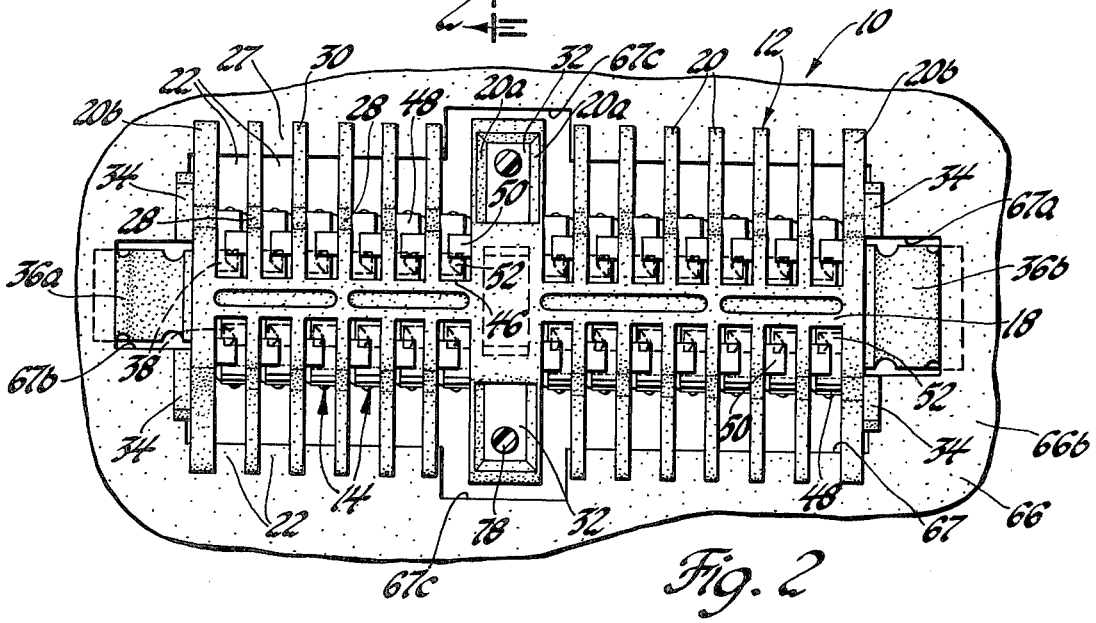
FIG. 2 is a section taken substantially along the line 2—2 of FIG. 1 looking in the direction of the arrows.
Figure 3:
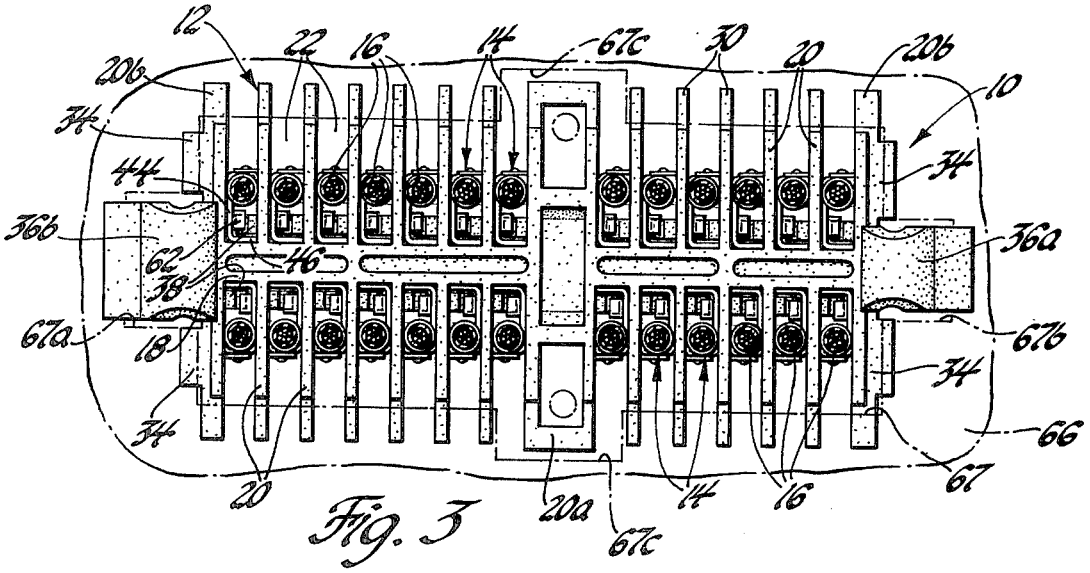
FIG. 3 is a section taken substantially along the line 3—3 of FIG. 1 looking in the direction of the arrows.

The terminal 14 is inserted into the channel 22 attachment or tail end first through the front opening 24 and seated against the front end of the longitudinal rib 38 with its side wall 44 disposed between the longitudinal rib 38 and one of the partition walls 20, 20*a* or 20*b* as shown in FIGS. 1 and 2. The terminal 14 is retained in the open channel 22 by its lateral flange 46 which is disposed in the slot 40 and its latch tang 62 which engages the shoulder 42 of the longitudinal rib 38 as shown in FIGS. 1 and 4.

Figure 5:
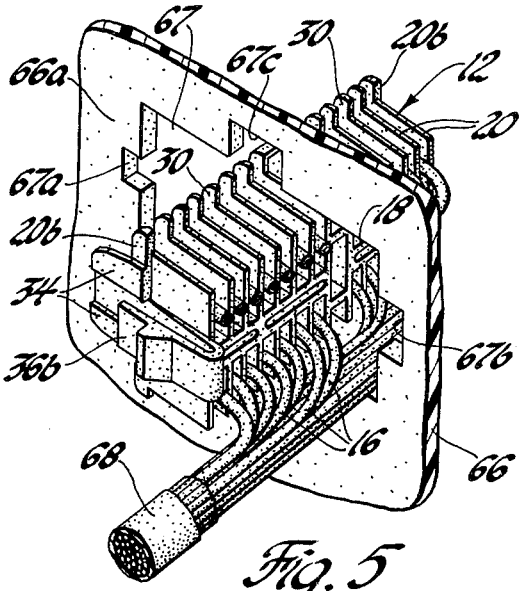
FIG. 5 is a perspective view showing the electrical connector in the process of being assembled to a panel.
Figure 7:
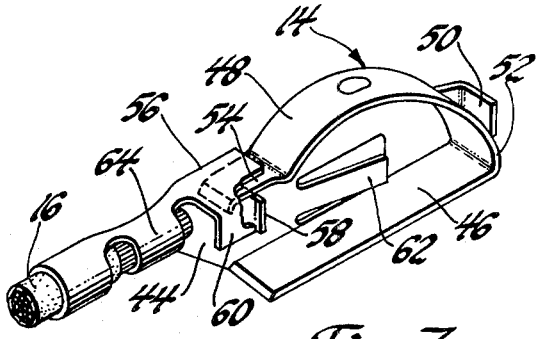
FIG. 7 is a perspective view of the terminal used in the electrical connector shown in FIGS. 1-6.

The electrical connector 10 is mounted on a support panel 66 from the backside 66*a* by threading the connector 10 sideways through an appropriately shaped hole 67 in the support panel 66 as shown in FIG. 5. After the connector 10 is threaded completely through the hole 67, the connector 10 is aligned with the hole 67 and pushed back into the hole 67 from the front side into the panel mounted position shown in FIG. 6. The connector body 12 is secured on the support panel 66 by the wings 30 which engage the front side 66*b* of the support panel 66 and the latch arms 36 which engage the backside 66*a*. In some instances, the connector 10 can be mounted from the front side 66*b* of the support panel 66, by threading the wiring harness 68 through the hole first. However, it is usually easier to mount the connector 10 from the backside 66*a* because the wiring harness 68 is often very long and complex.

The hole 67 has different sized side slots 67*a* and 67*b* and offset slots 67*c* in the other two sides. These slots cooperate with the different sized latch arms 36*a* and 36*b* and offset sockets 32, which as noted above serve as indexing means to insure that the connector 10 is properly mounted on the support panel 66.

Figure 6:
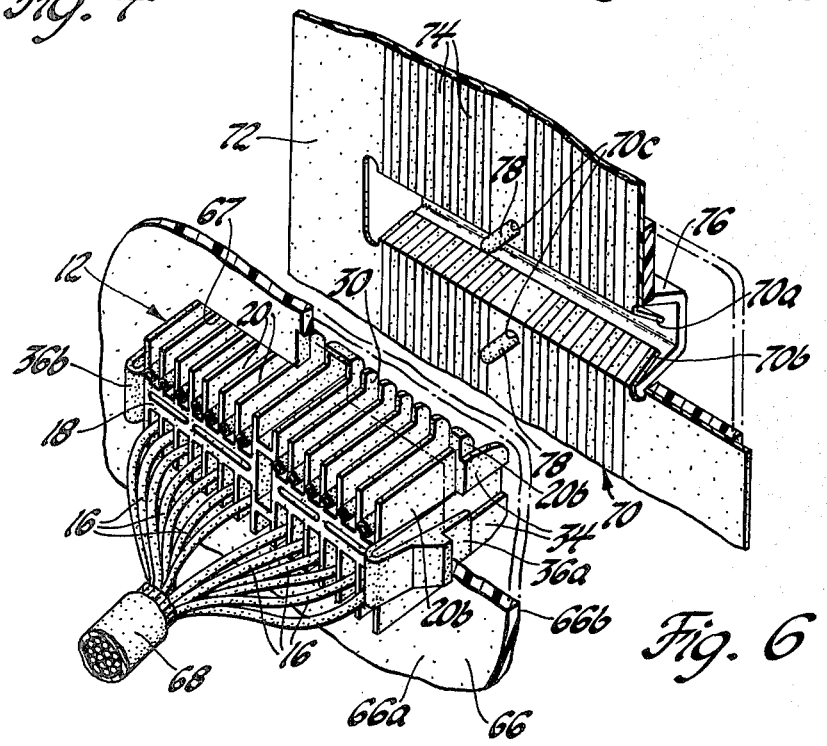
FIG. 6 is a perspective view showing the electrical connector assembled to a support panel and in position for connection with a flexible printed circuit mounted on its own support panel.

FIG. 6 also shows a representative flexible printed circuit 70 comprising a flexible Mylar sheet 72 having a plurality of thin conductive strips 74 attached to one surface. The flexible printed circuit 70 is cut to provide two flap portions 70*a* and 70*b* and two index holes 70*c*. The flexible printed circuit 70 is mounted on a socket member 76 which is shaped to plug onto the connector 10 supported on the panel 66. The socket member 76 has two projecting pins 78 which project through the index holes 70*c* in the Mylar sheet 72 to index the flexible printed circuit 70 on the socket member 76. These pins 78 plug into the sockets 32 of the connector body 12 when the socket member 76 is plugged onto the connector 10 to insure that the connector 10 and the flexible printed circuit are properly mated.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An electrical connector for a flexible printed circuit or the like, comprising, a connector body having a base wall and a plurality of upstanding partition walls projecting from said base wall to define a plurality of open channels, a longitudinal rib in each channel which projects into the channel from a partition wall on one side of the channel and is spaced from the partition wall on the other side of the channel, said longitudinal rib being spaced close to the base wall to define a slot, and a terminal disposed in each open channel, said terminal having a side wall disposed between the longitudinal rib and the partition wall on the other side of said channel, a lateral flange which is attached to a longitudinal edge of the side wall and which is disposed in the slot to retain the terminal in the transverse direction, a contact bow which is attached to a forward edge of the lateral flange and extends back thereover, said contact bow having a nose portion seated against the longitudinal rib to retain the terminal in the channel in one longitudinal direction and a median portion projecting outwardly of the channel for making an electrical connection, and a latch tang attached to the terminal which engages a shoulder of the longitudinal rib to retain the terminal in the channel in the opposite longitudinal direction.

2. An electrical connector for a flexible printed circuit or the like, comprising, a connector body having a base wall and a plurality of upstanding partition walls projecting from opposite sides of said base wall to define two rows of parallel open channels having a front opening, a rear opening and a longitudinal opening opposite the base wall, a longitudinal rib in each channel which projects into the channel from a partition wall on one side of the channel and is spaced from the partition wall on the other side of the channel, said longitudinal rib having a front adjacent the front opening of the channel, a shoulder facing the rear opening of the channel and cooperating with the base wall to define a slot, a terminal disposed in each open channel, said terminal having a side wall disposed between the longitudinal rib and the partition wall on the other side of said channel, a lateral flange which is attached to a longitudinal edge of the side wall and which is disposed in the slot to retain the terminal in the transverse direction, a contact bow which is attached to a forward edge of the lateral flange and extends back thereover, said contact bow having a nose portion seated against the front of the longitudinal rib to retain the terminal in the channel in one longitudinal direction and a median portion projecting outwardly of the channel through the longitudinal opening for making an electrical connection, and a latch tang attached to the side wall which engages the shoulder of the longitudinal rib to retain the terminal in the channel in the opposite longitudinal direction.

3. A terminal for making an electrical connection to a flexible printed circuit or the like, comprising, a side wall having a lateral flange attached at a longitudinal edge, a contact bow which is attached to a forward edge of the lateral flange and extends back thereover, said contact bow having a nose portion and a median portion projecting outwardly of the side wall for making an electrical connection and a tail, a tab which is connected to a front edge of the side wall and which extends in front of the nose to protect the nose and reinforce the nose when a force is applied to an inside surface of the nose in a direction toward the tab, and a cable attachment portion which is attached to a rear edge of the side wall and which is offset away from the lateral flange attached to one longitudinal edge of the side wall and toward the opposite longitudinal edge of the side wall to permit access to the inside surface of the nose between the cable attachment portion and the lateral flange in the longitudinal direction.

4. A terminal for making an electrical connection to a flexible printed circuit or the like, comprising, a side wall having a lateral flange attached at a longitudinal edge, a contact bow which is attached to a forward edge of the lateral flange and extends back thereover, said contact bow having a nose portion and a median portion projecting outwardly of the side wall for making an electrical connection and a tail, a tab which is connected to a front edge of the side wall and which extends in front of the nose to protect the nose and reinforce the nose when a force is applied to an inside surface of the nose in a direction toward the tab, a latch tang which is struck and bent from the side wall so as to project over the lateral flange toward the nose, and a cable attachment portion which is attached to a rear edge of the side wall and which is offset away from the lateral flange attached to one longitudinal edge of the side wall and toward the opposite longitudinal edge of the side wall to permit access to the inside surface of the nose between the cable attachment portion and the lateral flange in the longitudinal direction.

5. A terminal for making an electrical connection to a flexible printed circuit or the like, comprising, a side wall having a lateral flange attached at a longitudinal edge, a contact bow which is attached to a forward edge of the lateral flange and extends back thereover, said contact bow having a nose portion and a median portion projecting outwardly of the side wall for making an electrical connection and a tail, a tab which is connected to a front edge of the side wall and which extends in front of the nose to protect the nose and reinforce the nose when a force is applied to an inside surface of the nose in a direction toward the tab, a side tab which is attached to the side wall and which is disposed inwardly of the tail for supporting the tail when the contact bow is depressed, said side tab being spaced from the lateral flange to permit access to the inside surface of the nose between the side flange and the lateral flange in the longitudinal direction, and a cable attachment portion which is attached to a rear edge of the side wall and which is offset away from the lateral flange attached to one longitudinal edge of the side wall and toward the opposite longitudinal edge of the side wall to permit access to the inside surface of the nose between the cable attachment portion and the lateral flange in the said longitudinal direction.

6. A terminal for making an electrical connection to a flexible printed circuit or the like, comprising, a side wall having a lateral flange attached at a longitudinal edge, a contact bow which is attached to a forward edge of the lateral flange and extends back thereover, said contact bow having a nose portion and a median portion projecting outwardly of the side wall for making an electrical connection and a tail, a tab which is connected to a front edge of the side wall and which extends in front of the nose to protect the nose and reinforce the nose when a force is applied to an inside surface of the nose in a direction toward the tab, a small lateral flange which is attached to the opposite longitudinal edge of the side wall and which is disposed outwardly of the tail for limiting outward movement of the contact bow, said small lateral flange having a depending finger extending therefrom to trap the tail laterally in cooperation with the side wall, and a cable attachment portion which is attached to a rear edge of the side wall and which is offset away from the lateral flange attached to one longitudinal edge of the side wall and toward the opposite longitudinal edge of the side wall to permit access to the inside surface of the nose between the cable attachment portion and the lateral flange in the longitudinal direction.

7. A terminal for making an electrical connection to a flexible printed circuit or the like, comprising, a side wall having a lateral flange attached at a longitudinal edge, a contact bow which is attached to a forward edge of the lateral flange and extends back thereover, said contact bow having a nose portion and a median portion projecting outwardly of the side wall for making an electrical connection and a tail, a tab which is connected to a front edge of the side wall and which extends in front of the nose to protect the nose and reinforce the nose when a force is applied to an inside surface of the nose in a direction toward the tab, a latch tang which is struck and bent from the side wall so as to project over the lateral flange toward the nose, a side tab which is attached to the side wall and which is disposed inwardly of the tail for supporting the tail when the contact bow is depressed, said side tab being spaced from the lateral flange to permit access to the inside surface of the nose between the side flange and the lateral flange in the longitudinal direction, a small lateral flange which is attached to the opposite longitudinal edge of the side wall and which is disposed outwardly of the tail for limiting outward movement of the contact bow, said small lateral flange having a depending finger which extends therefrom past the side tab to trap the tail in cooperation with the side wall, and a cable attachment portion which is attached to a rear edge of the side wall and which is offset away from the lateral flange attached to one longitudinal edge of the side wall and toward the opposite longitudinal edge of the side wall to permit access to the inside surface of the nose between the cable attachment portion and the lateral flange in the longitudinal direction.

8. An electrical connector for a flexible printed circuit or the like, comprising, a connector body having a base wall and a pair of upstanding walls projecting from said base wall to define an open channel, a longitudinal rib in said channel which projects into the channel from an upstanding wall on one side of the channel and is spaced from the upstanding wall on the other side of the channel, said longitudinal rib being spaced close to the base wall to define a slot, and a terminal disposed in said open channel, said terminal having a side wall disposed between the longitudinal rib and the upstanding wall on the other side of said channel, a lateral flange which is attached to a longitudinal edge of the side wall and which is disposed in the slot to retain the terminal in the transverse direction, a contact bow which is attached to a forward edge of the lateral flange and extends back thereover, said contact bow having a nose portion seated against the longitudinal rib to retain the terminal in the channel in one longitudinal direction and a median portion projecting outwardly of the channel for making an electrical connection, and a latch tang attached to the terminal which engages a shoulder of the longitudinal rib to retain the terminal in the channel in the opposite longitudinal direction.

9. An electrical connector for a flexible printed circuit or the like, comprising, a connector body having a base wall and a pair of upstanding walls projecting from opposite sides of said base wall to define an open channel having a front opening, a rear opening and a longitudinal opening opposite the base wall, a longitudinal rib in said channel which projects into the channel from an upstanding wall on one side of the channel and is spaced from the upstanding wall on the other side of the channel, said longitudinal rib having a front adjacent the front opening of the channel, a shoulder facing the rear opening of the channel and cooperating with the base wall to define a slot, a terminal disposed in said open channel, said terminal having a side wall disposed between the longitudinal rib and the partition wall on the other side of the channel, a lateral flange which is attached to a longitudinal edge of the side wall and which is disposed in the slot to retain the terminal in the transverse direction, a contact bow which is attached to a forward edge of the lateral flange and extends back thereover, said contact bow having a nose portion seated against the front of the longitudinal rib to retain the terminal in the channel in one longitudinal direction and a median portion projecting outwardly of the channel through the longitudinal opening for making an electrical connection, and a latch tang attached to the side wall which engages the shoulder of the longitudinal rib to retain the terminal in the channel in the opposite longitudinal direction.

* * * * *